US005964418A

United States Patent [19]

Scarpa et al.

[11] Patent Number: 5,964,418

[45] Date of Patent: Oct. 12, 1999

[54] SPRAY NOZZLE FOR APPLYING METAL-FILLED SOLVENTLESS RESIN COATING AND METHOD

[75] Inventors: Jack G. Scarpa; James Fletcher Burgess, both of Huntsville; John D. Marlin, Tony; Matthew Kelly; Anthony Howard, both of Huntsville, all of Ala.

[73] Assignee: USBI Co., Kennedy Space Center, Fla.

[21] Appl. No.: 08/990,209

[22] Filed: Dec. 13, 1997

[51] Int. Cl.[6] ..... B05B 7/08

[52] U.S. Cl. ..... 239/424; 239/428; 239/429; 239/433

[58] Field of Search ..... 239/422, 423, 239/424, 428, 429, 433, DIG. 8

[56] References Cited

U.S. PATENT DOCUMENTS 4,854,504 8/1989 Hedger, Jr. et al. ..... 239/428 X 5,307,992 5/1994 Hall et al. ..... 239/135

5,447,567 9/1995 Tanaka et al. ..... 239/424 X 5,565,241 10/1996 Mathias et al. ..... 427/196

*Primary Examiner*—Lesley D. Morris

*Attorney, Agent, or Firm*—Norman Friedland

[57] ABSTRACT

A convergent spray gun which combines a liquid resin and dry metallic powder externally of the nozzle of the spray gun that utilizes a pair of diametrically opposing passages disposed at 0° and 180° relative to the central resin discharging orifice where the central orifice is approximately 0.015 inch and the air for atomizing the fluids is approximately 0.187 inch and the atomizing angle is approximately 90°. The metallic filler is added to the plume of the convergent spray at the low pressure section and the ratio of the fluids are controlled by a computerized system. The spray gun, controls and mixing chambers of the resin (two part) and powder fillers are housed in separate rooms and the dust where the powder fillers are metered is controlled.

14 Claims, 4 Drawing Sheets

SPRAY NOZZLE FOR APPLYING METAL-FILLED SOLVENTLESS RESIN COATING AND METHOD

TECHNICAL FIELD

This invention relates to apparatus and method of applying coatings to a substrate and particularly to the apparatus and method for coating a substrate with highly metallic powdered-filled solventless resins.

BACKGROUND OF THE INVENTION

As is well known in the spray coating technology the heretofore known spray application equipment for coating substrates with conventional high solids have transfer efficiencies that are less than 50% which results in excessive loss of materials, solvents and time. Of significance in this technology is the ecological standards that one must consider since the impact on the quantities of materials, solvents and volatile organic compounds that are released into the atmosphere are not only a major concern of the caring individuals but must comply with the Occupational Safety and Health Administration (OSHA) and the Environment Protection Agency (EPA) requirements. Moreover, the current conventional coating systems presents a myriad of problems including, but not limited to, safety to the operators, environmental hazards, high costs and difficulties encountered when attempting to apply the coating.

There has always been a need for a high solid coating system that would coat the substrate with solids that would be between 5–10 mils thick in one pass without the necessity of a solvent.

We have found that we can provide a uniquely designed spray apparatus and method of applying the spray to the substrate while obtaining substantially 100% solids. The convergent spray technique of this invention will not only obviate the problems alluded to in the above paragraph but will eliminate the use of hazardous materials that would otherwise be used. It is contemplated by this invention to use a forced air stream to introduce the dry metallic filler material into a wet resin stream where it is convergently combined with the resin components. This invention contemplates utilizing a spray nozzle and system that is similar to that disclosed in U.S. Pat. No. 5,565,241 granted on Oct. 15, 1996 to Mathias et al of which Jack G. Scarpa, is a common co-inventor, entitled "Convergent End-Effector" and U.S. Pat. No. 5,307,992 granted on May 3, 1994 to Hall et al of which Jack G. Scarpa is a common co-inventor, entitled "Method and System For Coating A Substrate With A Reinforced Resin Matrix" both of which are commonly assigned to USBI Co., and which are incorporated herein by reference. As stated in the U.S. Pat. Nos. 5,565,241 and 5,307,992 patents, supra, the apparatus for applying the coating of reinforced resins matrix to a substrate is a spray nozzle that includes a centrally disposed orifice and a plurality of circumferentially spaced orifice(s) surrounding the center orifice for creating an atomizing zone. Included are other orifices radially spaced outwardly from these orifices which are used for shaping the spray. Reinforcing material is introduced to the resin through the aft end of an encircling chamber or manifold that surrounds the spray nozzle and is designed to feed the reinforcing material to the liquid resin. Pneumatic eductor lines for conducting compressed air are utilized to transport the materials to the substrate.

The present invention modifies the circumferential air atomization cap of heretofore known spray nozzle to include a central orifice that measures approximately 0.187 in diameter and includes an atomization angle of 90°. The filler is concentrated into two distinct streams thus eliminating the buildup of the material on the surfaces and crevices of the spray applicator and transfer lines. This will result in enhanced transfer efficiencies and a more consistent finish of the coating on the substrate surface. The method employed utilizes a hopper and gravity fed loss-in-weight feed system under control into an eductor manifold system that transports the filler material through two separate streams prior to arrival at the spray applicator. A constant dry filler to liquid resin ratio assures a consistently applied coating.

By controlling the amounts and rates of resin and dry metallic filler and the proper ratios for coating selected surfaces, the entire system delivers, meters and mixes these materials only on demand of the convergent applicator with a consequential elimination of the requirement to pre-mix the coating formulations. This convergent spraying technique for dry fillers and resins provide a uniform controllable coating and if desired, this invention contemplates the option of heating the separate resins (when two or more resins are utilized) so as to accelerate the gel times of the sprayed materials. This optional method enhances the coating since it allows for a uniform buildup of the coating.

This invention has been particularly efficacious for solventless application of MagRam type of coatings (stealth applications) and highly filled zinc or other metallic fillers for corrosion resistance.

The system and spray nozzle of this invention also provides the following improvements, although not limited thereto, over the heretofore known system:

This system is compatible with epoxy, polyurethane, silicate water base or 100% solid resin systems;

This system has the ability to more accurately control thickness of applied coating;

This system has the ability to control the dimensions of surface area to be coated;

This system has the ability to control both filler and resin material independently;

The system reduces the number of required passes to attain a desired thickness of the coating in contrast to solvent borne systems;

This system reduces waste and hazardous materials;

This system has the propensity of reducing of time required to apply coating, reducing the time to test MagRam properties of coatings, and reduces solvents (VOC's) to apply zinc rich coatings; and This system optimizes the loading capabilities by allowing the loading to be between 0%—a high of over 90%. This is also dependent upon resin and atomization characteristics of resin compenents.

DISCLOSURE OF THE INVENTION

An object of this invention is to provide improved spray nozzle apparatus for applying metal filled coatings to a surface of a substrate.

Another object of this invention is to provide spray nozzle apparatus that is capable of achieving a solution that is 100% solids and applying a substantially thick coating without the use of solvents and the thickness could range as much as 5–10 mils in one pass.

A feature of this invention is a convergent spray applicator utilized forced air stream to introduce the dry metallic filler into the wet resin stream where it is convergently combined with the resin components. Two distinct streams are utilized for the concentrated dry filler that eliminate the buildup of material on the surfaces and crevices of the spray applicator and the attendant transfer lines. This system is characterized as affording the advantages enumerated in the above paragraphs.

The method of applying the coating is transporting the filler material through two separate lines by a manifold controlled loss-in-weight volume feed system that is gravity fed from a hopper containing the filler material. The system maintains a constant dry filler to liquid resin ratio to assure a consistently applied coating.

A feature of this invention is the arrangement of the various components of the convergent process system by designating certain components of the process and assigning them in separate rooms or areas and controlling the mixing of the components of the coating in a dust free separate room and utilizing robotics to position the spray gun and a control system remotely located from the spray booth housing the spray gun and substrate.

Another feature of this invention is the method of coating utilizing a metallic powder filler combined with a liquid resin at the exterior of a convergent spray coating nozzle of the spray gun prior to the application of the coating on a substrate.

The foregoing and other features of the present invention will become more apparent from the following description and accompanying drawings.

These figures merely serve to further clarify and illustrate the present invention and are not intended to limit the scope thereof.

BEST MODE FOR CARRYING OUT THE INVENTION

While this invention shows in the preferred embodiment the spray nozzle apparatus and system for coating the substrate with Mag Ram or Zinc it is to be understood that other metallic material for coating the substrate can be utilized without departing from the scope of this invention. Also, it is noted that although these materials are described as being utilized for radar adsorption and corrosion applications this invention contemplates that other materials may be used for these purposes and for other purposes. As one skilled in this technology will appreciate, this invention is directed to introduce dry metallic filler into the wet resin downstream of the nozzle's orifices where it is convergently combined with the resin components just prior to being sprayed on the surface of the substrate. In the preferred embodiment the system is automated and computer controlled utilizing the requisite pumps, valves, actuators, sensors and robotics to position the spray nozzle relative to the substrate. It being understood that this invention can be practiced without the utilization of automation.

Figure 1:
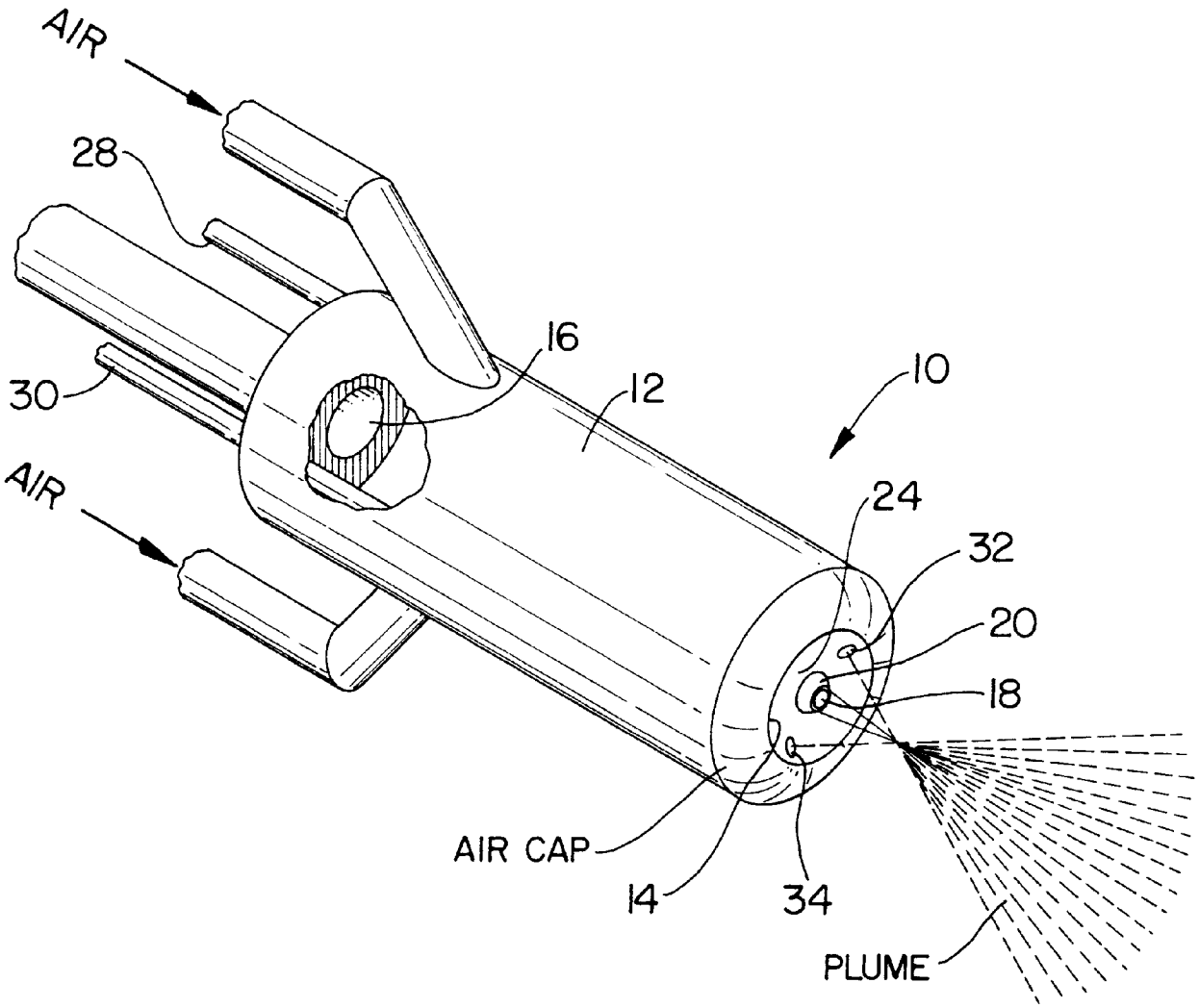
FIG. 1 is a view in perspective illustrating the convergent spray nozzle of this invention.
Figure 2:
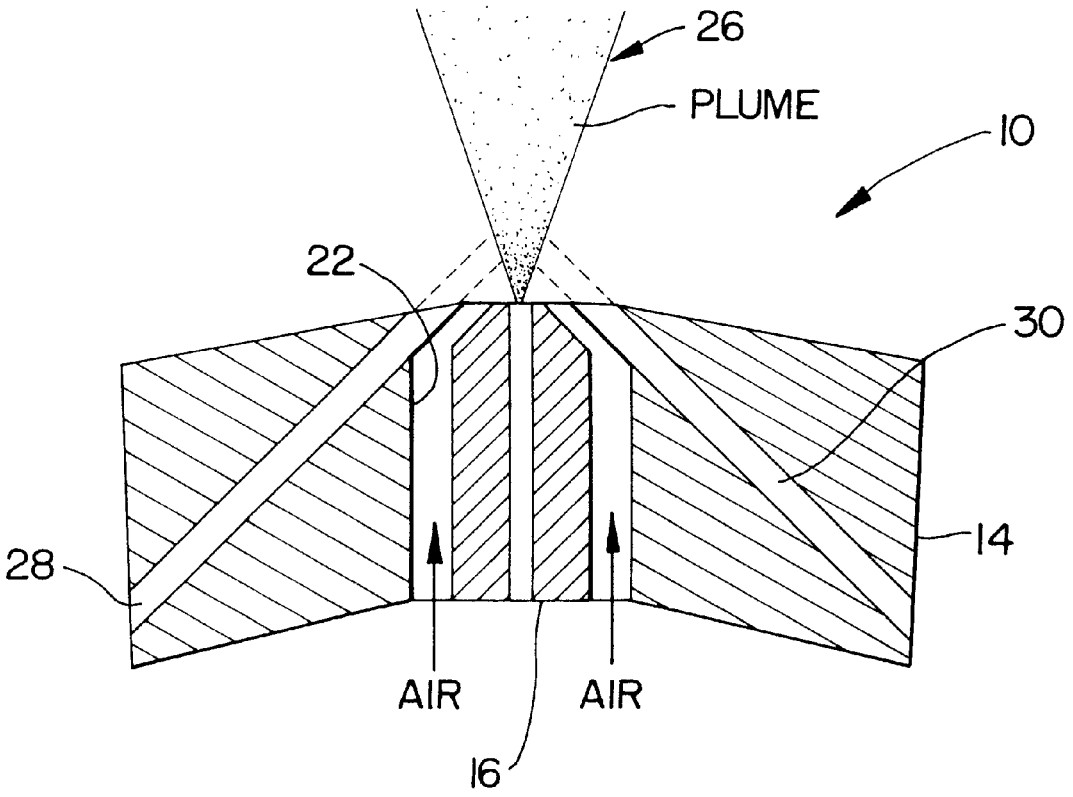
FIG. 2 is a partial elevation view in section illustrating the air cap portion of the convergent spray coating nozzle of this invention.
Figure 3:
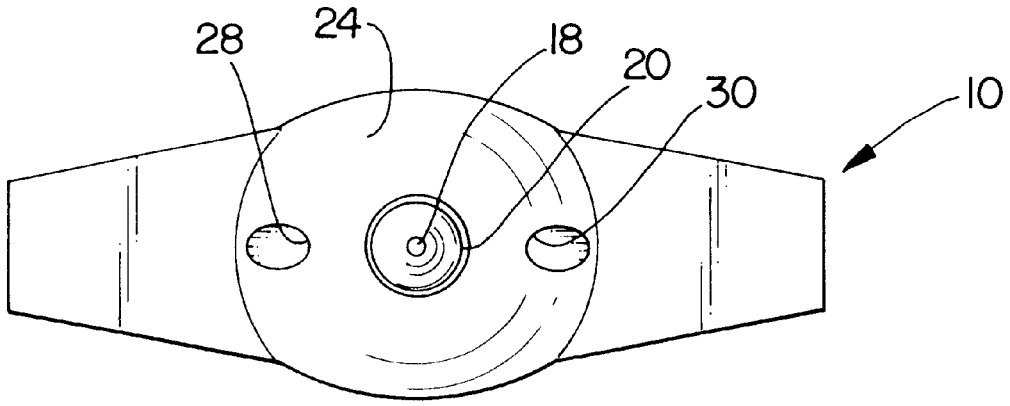
FIG. 3 is a top down plan view of the front end of the spray nozzle illustrated in FIG. 2.

The invention can best be understood by referring to all the Figs. where FIG. 1 shows the convergent spray nozzle generally illustrated by reference numeral 10 as having a cylindrical housing 12 including the air cap 14 supporting the tubular resin conveying member 16. The spray nozzle 10 may be a suitable commercially available nozzle that is modified in accordance with this invention. A suitable commercially available nozzle can be the spray nozzles manufactured by Binks, located in Franklin Park, Ill. The resin conveying member 16 includes a centrally disposed discharge orifice 18 for injecting the liquid resin into the airstream created by the annular orifice 20 surrounding the central orifice 18. The orifices are designed to provide an atomized convergent spray in much the same manner as that disclosed in the U.S. Pat. No. 5,565,241 patent, supra. For further details of the spray nozzle reference should be made to this patent. Suffice it to say that instead of the surrounding circumferentially spaced individual orifices for injecting the air for atomization purposes this nozzle is configured to include the annular orifice 20 (FIG. 3) judiciously sized to substantially equal 0.187 inch. The orifice 18 is preferably sized to equal substantially 0.015 inch. As one skilled in the art will appreciate, the sizes of the orifices and their orientation relative to each other are important aspects of this invention since it is necessary to achieve satisfactory mixing of the ingredients prior to the application on the substrate. The air passage 22 (FIG. 2) in the air cap is contoured so that the surface 24 defines an angle so that the air being discharged from orifice 20 may be between 20 degrees(°)–90° at the point where it converges with the plume and preferably is substantially equal to 90° taken through any vertical plane and is centrally oriented with the discharge from the orifice 18. This provides the proper convergence and assures that the plume of the liquid resin when atomized takes the shape indicated by the plume 26.

As will be more fully explained herein below, it is abundantly important that the powder injected into the resin becomes completely wetted and homogeneous with the resin to assure a uniform and consistent finish of the coating on the substrate surface. As is disclosed in the U.S. Pat. No. 5,565,241 patent, supra, the liquid resin is fed to the discharge orifice 18 where it is combined with the air to form an atomized spray. In the event more than one resin is desired a second resin or other constituents may be mixed immediately prior to being admitted into the spray nozzle. Obviously, the exact sizing of the orifices 18 and 20 will be predicated on the particular resins selected and the desired droplet size and pressure necessary to perform the desired mixing to achieve the homogeneous mixture. In the preferred embodiment the viscosity of the liquid resin should be in the 1,000 to 5,000 centipoise (cps) range. In fact, the particular parameters for achieving the desired coating is within the purview of one skilled in this art, recognizing the diameter sizes indicated in the above paragraph of orifices 18 and 20 are the preferred. The viscosity may also be controlled by applying heat thereto in a well known manner.

Figure 4:
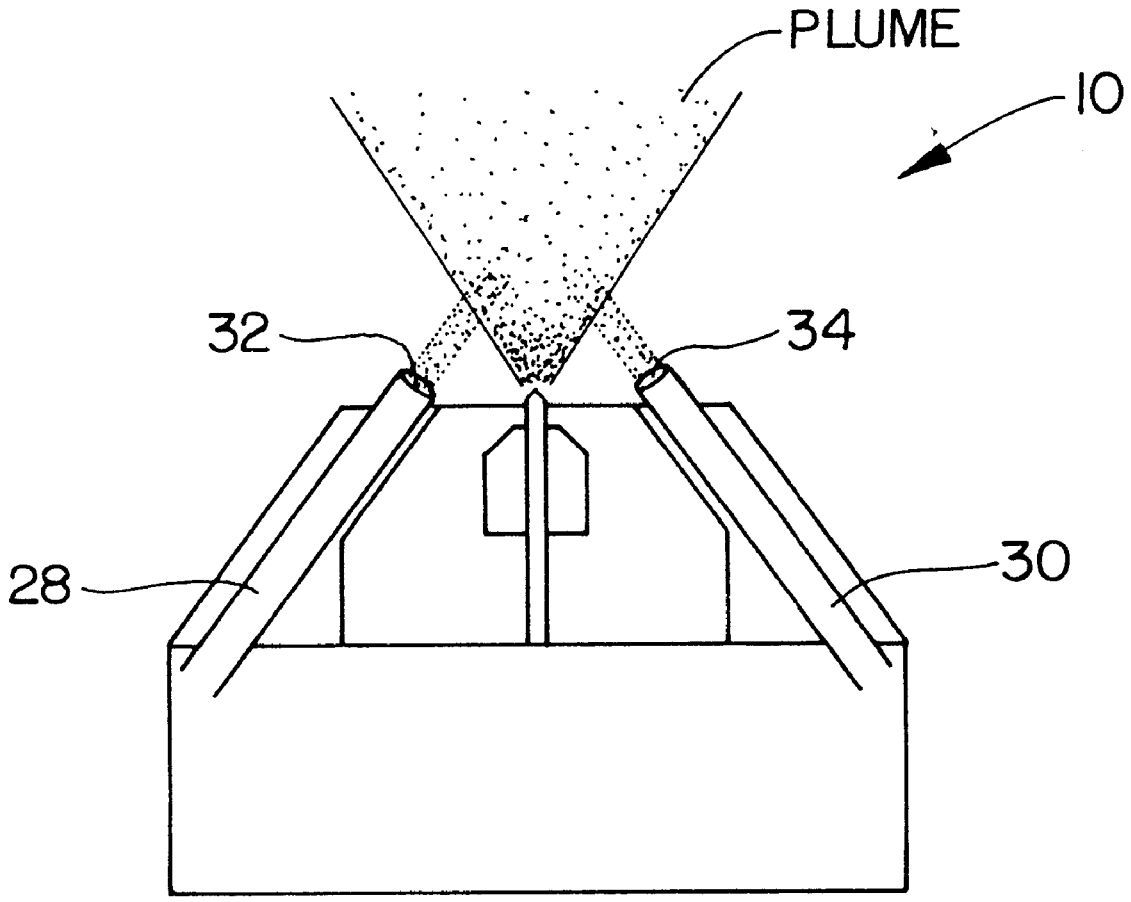
FIG. 4 is a schematic of the atomization air cap of the spray nozzle of FIG. 2 illustrating the relationship of the resin and powder feed lines and coating mixture just prior to application on the substrate surface.

In accordance with this invention the fine metallic powder is introduced to the liquid resin by two judiciously oriented streams 28 and 30 (FIG. 4) feeding judiciously oriented discharge orifices 32 and 34, respectively. The filler material that is transported by the air stream as will be explained in more detail hereinbelow is judiciously angled relative to the plume of the resin and introduced to the plume at a given location as shown in the Figs. in order to achieve the desired uniformity and consistency of the coating. The diametrically disposed discharge orifices 32 and 34 are at 0° and 180°, respectively, The parameters for the discharge orifices 32 and 34 will be predicated on a number of parameters, such as transport air pressure, particle sizes, density, type of material, etc. that are within the skilled artisan. What is of the utmost importance is that the passages 28 and 30 and the respective orifices 32 and 34 are oriented to introduce the filler at the low pressure point of the plume so that these two streams will eliminate the buildup of the material on surfaces and crevices of the spray applicator and the attendant transfer lines while assuring the consistent finish of the coating on the substrate surface.

As alluded to in the above paragraphs, this invention contemplates maintaining a constant dry filler to liquid resin ratio to assure a consistently applied coating. As will be detailed herein below the system delivers, meters and mixes the required materials in proper ratios to attain the proper amounts and rates of material only on demand of the convergent applicator. This will result in a system that eliminates the requirement to pre-mix the coating formulation. This system is describe in connection with FIG. 5 which indicates that the process is best achieved by separating certain functions of the system in three distinct rooms or areas which consist of the control room 40, the mixing room 42 and the spray booth 44 (FIG. 5).

The entire process is controlled by a suitable general purpose computer generally illustrated by reference numeral 46 which is suitably programmed by any skilled programmer to generate the desired signals to attain the proper flows and ratios and should include, but not necessarily require, a recorder 48 to obtain a read out of the activities of the process, and a PLC process control 50. The processor includes suitable control mechanism for controlling the various components as represented by box 54, such as the gun trigger, solvent flush, air transports, dry powder and resins via the various solenoid control valves in the system. The process control also monitors the amounts for the various materials and in a well known manner processes a hard read out copy. In applications where heat is applied the control room 40 would house the suitable relays 56 for actuating the desired heating elements (not shown) but would be of the type described in the U.S. Pat. No. 5,565,241 patent, supra.

Figure 5:
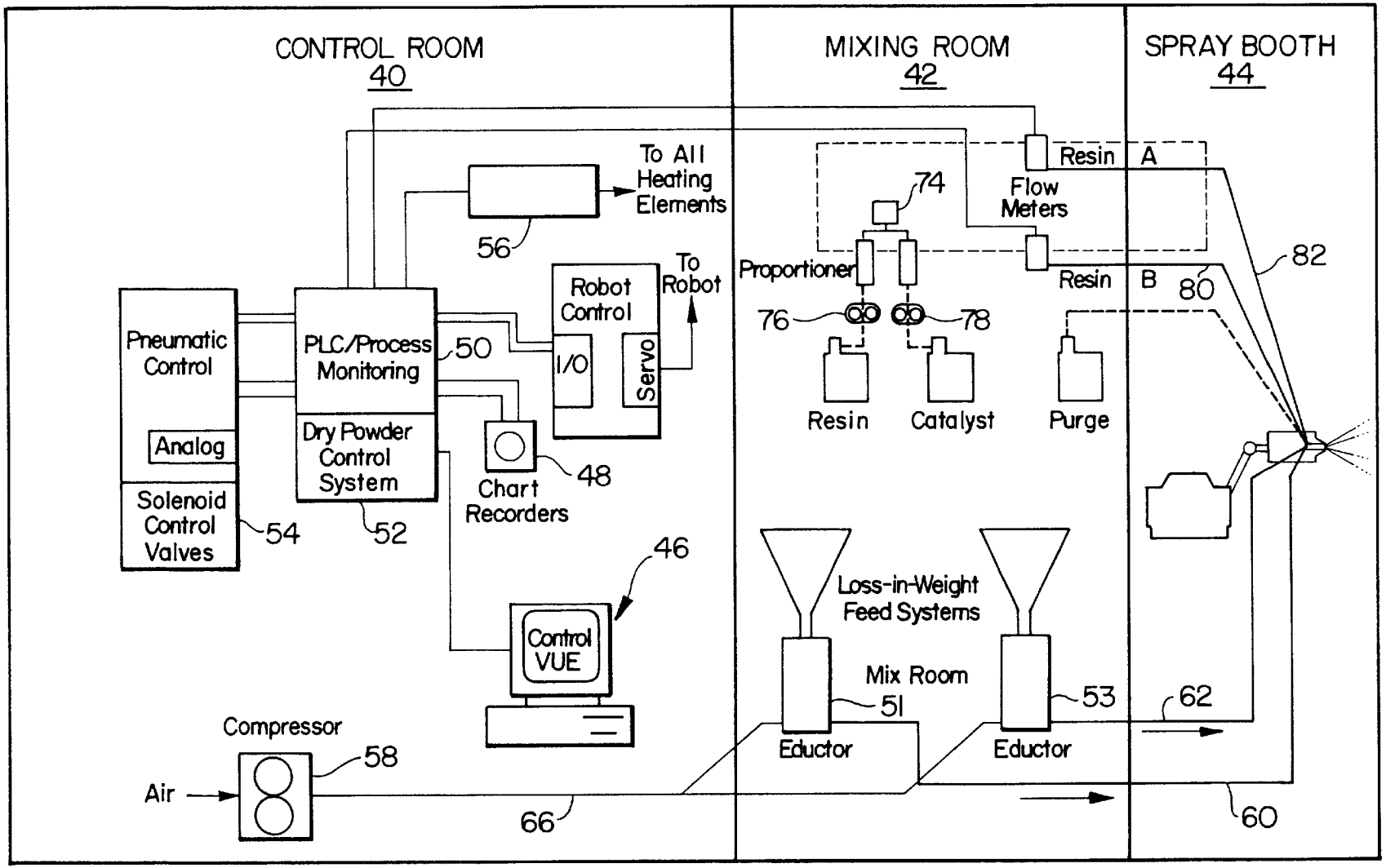
FIG. 5 is a schematic partly in block diagrammatic illustration of the system utilized in proportioning the materials utilized in the coating, transporting the materials and the controls therefore.

As noted in FIG. 5 the computer 46 in the control room 40 serves to control the rates of flow of the dry powder by actuating the eductors 51 and 53 in the mixing room 42 and the air compressor 58 in the control room 40. The eductors are a loss-in-weight feed system of the type that is described in the U.S. Pat. No. 5,565,241 patent, supra. Obviously, the dry powder system includes a hopper for the fine particle fillers and serves to maintain a constant volume or weight of powder by replacing the amounts that are being utilized by the spray applicator which are transported thereto by the relatively low air pressure lines 60 and 62. Each eductor 51 and 53 are connected to the air lines 60 and 62 and receive the compressed air from pump 58 via line 66 and branch line 68. The resin which may include a catalyst is metered to the spray nozzle by the flow metering valves 70 and 72 which are controlled by the computer 46 in order to maintain the proper amounts and proper ratio relative to the powder filler. The resin and catalyst which are contained in vats are proportioned by a suitable proportioner 74 and pumped to the spray nozzle via pumps 76 and 78 and delivered to the spray nozzle via flow lines 80 and 82. A purging system may be included in order to clean the nozzle at appropriate times. The dust content of the mixing room that contains the eductors, loss-in-weight feed system and supply of the resin components and filler material is controlled to assure that the coating is free of foreign matter so as not to contaminate the finished coating.

The spray gun which is isolated in the spray booth, may be robotically operated by a suitable robot such as the GMF robot which is controlled by the robot controller in a well known manner.

The following is an example of the inventive method utilizing the inventive spray nozzle for applying a high solid coating with more than 90% metal filler applied to the substrate surface to obtain a coating thickness of substantially between 5–10 mil in one pass. It will be noted that the filler is transported to the gun and mixed with the liquid resin at the discharge end of the spray nozzle without the use of any solvents. While this example is presented to illustrate the process of coating a substrate with particular materials, it is to be understood that this example is not to be interpreted as being a limitation of the scope of this invention.

EXAMPLE

1. Iron type powder is transferred pneumatically through two (2) ½ inch inside diameter Teflon coated hoses and combined with a two (2) part polyurethane epoxy system using the convergent spray technology of this invention to create a uniform, ten (10) mil thick coating.
2. The iron powder is delivered to the two (2) eductors using vibratory feeders which accurately control the feed rate of 4500 grams per hour by means of the PLC monitoring system 52. Eductor air pressure is at 10–12 pounds per square inch (psi) which is sufficient air pressure to move iron particles to the spray gun. All air pressure is controlled through a Pneumatic Control System using solenoid control valves 54 to regulate individual pressures to specific devices.
3. Gear pumps are used to accurately transfer the two (2) part polyurethane epoxy to the spray gun at a rate of 8 cubic centimeters (cc) per minute for each liquid. Both epoxy components are heated to 110° fahrenheight (F) inside pressure pots. The lines carrying the fluid have an internal diameter of ¼ inch and carry the fluids through flow meters 70 and 72 for an accurate flow measurement. Both fluid lines are heated to 110° F. using electric heat tape 56.
4. The fluids, after being combined while passing through a mixing chamber, exit through a 0.0015 inch orifice a the tip of the fluid nozzle. Atomizing air, flowing at approximately 30 psi, propels the fluid into a mist. All feed rates pressures and temperatures are controlled by the host P.C. using Control View software.
5. A GMF robot is used to move the spray gun across the substrate in an even manner at a stand off of eight (8) to ten (10) inches. Each pass of the spray gun overlaps one (1) inch. The spray gun moves at a rate of six (6) to eight (8) inches per second.

While the example detailed in the immediately above paragraph illustrates a coating utilizing an iron filler, it will be obvious that other metallic fillers such as zinc may be equally utilized by this invention. The coating was highly loaded with solids (70–85% metal filled) and the thickness of the coating was between 5–10 mils that was achieved in one pass. The metal filling required no solvents as the convergent spray nozzle made the mixture of the metal filling and liquid resin on the exterior of the spray nozzle.

Although this invention has been shown and described with respect to detailed embodiments thereof, it will be appreciated and understood by those skilled in the art that various changes in form and detail thereof may be made without departing from the spirit and scope of the claimed invention.

It is claimed:

1. A convergent spray nozzle for spraying a coating onto a substrate, said convergent spray nozzle having a generally cylindrically shaped body for receiving pressurized air, said body being closed at one end and having a restricted outlet for discharging pressurized air into a convergent pattern for defining a plume of atomized air, a central passage formed in said body for conveying a liquid resin to a central orifice formed at said closed end for discharging said liquid resin into said convergent pattern to atomize said liquid resin to form small particles within said plume, a pair of diametrically opposed passages formed in said body and leading fine metallic powder into diametrically disposed orifices spaced radially from said central orifice for directing said metallic powder into said plume to form a mixture with said liquid resin prior to being applied to said substrate.

2. A convergent spray nozzle for spraying a coating onto a substrate as claimed in claim 1 wherein the diameter of said central orifice is substantially equal to 0.015 inch.

3. A convergent spray nozzle for spraying a coating onto a substrate as claimed in claim 2 wherein said diametrically opposed passages are oriented at an angle of 45° relative to said central orifice for injecting said metallic powder into the area adjacent to the apex of said plume.

4. A convergent spray nozzle for spraying a coating onto a substrate as claimed in claim 3 wherein said diametrically opposed orifices are oriented respect to the central orifice at 0° and 180°.

5. A convergent spray nozzle for spraying a coating onto a substrate as claimed in claim 4 wherein said atomizing discharge orifice is annular in shape and disposed concentrically relative to said central orifice and discharges the air to converge with said plume at an angle of 90° relative to said plume.

6. A spray coating apparatus, comprising a spray gun having i. a spray nozzle for directing liquid resin toward a substrate intended to be coated, said nozzle having a central orifice and an atomizing orifice surrounding said central orifice, ii. a conduit for introducing liquid resin to said nozzle, iii. said spray nozzle having a cylindrically shaped body and being closed at one end, said conduit for leading the liquid resin into a central orifice formed in said one end for injecting liquid resin, said housing having passage for leading air into an orifice surrounding said central orifice for injecting a stream of atomizing air downstream of said orifice and defining with said liquid resin a convergent stream of atomized liquid resin for defining a plume having a low pressure section, iv. a pair of diametrically opposed passages in said housing and leading metallic powder into discharge outlets formed in said one end on opposite sides of said central orifice for directing said metallic powder into the low pressure section of said plume prior to being impinged on said substrate, vi. a source of liquid spray connected to said conduit and a source of metallic powder connected to each of said diametrically opposed passages, and vii. air pressure for transporting said metallic powder to said discharge outlets whereby the metallic powder mixes with said atomized liquid resin downstream of said central nozzle and in said plume prior to being applied to said substrate.

7. A spray coating apparatus as claimed in claim 6 wherein said diametrically opposed passages are disposed at 45° angles relative to said central orifice.

8. A spray coating apparatus as claimed in claim 7 wherein one of said diametrically opposed passages are at 0° and the other diametrically opposed passages is at 180° with respect to said central orifice.

9. A spray coating apparatus as claimed in claim 8 wherein the diameter of said central orifice is substantially equal to 0.015 inch.

10. A spray coating apparatus as claimed in claim 9 wherein the area of said orifice surrounding said central orifice is substantially equal to 0.0187 inch.

11. A system for applying a coating to a substrate including metallic powder comprising, a spray gun having i. an elongated body closed at one end, a conduit for leading liquid resin to a central orifice at said one end and a passage in said body for leading air into an annular discharge port surrounding said central orifice for atomizing said liquid resin and forming a convergent spray defining a plume with a low pressure section, ii. diametrically opposed passages for leading the metallic powder to diametrically opposed discharge ports for admitting metallic powder into the low pressure section of said plume, means for measuring the amount of liquid resin and the amount of metallic powder to define a given ratio of the two mediums, transporting means for conducting the liquid resin to said conduit and for conducting said metallic powder to said spray nozzle in the desired proportions, a process control/computer system for controlling the proper ratio of the two mediums, and said transporting means includes a pair of air eductors for leading metallic powder into said diametrically disposed passages whereby the metallic powder mixes with said atomized liquid resin in said plume before being applied to said substrate.

12. A system for applying a coating to a substrate as claimed in claim 11 including a loss-in weight feed system for feeding the eductor the required amount of metallic powder in order to maintain the desired ratio.

13. A system for applying a coating to a substrate as claimed in claim 12 including a robot for supporting said spray gun and moving it in a given direction and speed and said computer means for controlling said robot.

14. A system for applying a coating to a substrate as claimed in claim 13 wherein said computing system is housed in one room, and said eductor and loss in weight feed system is housed in a separate room, and means for controlling the dust content of said separate room.

* * * * *